United States Patent [19]

Chang

[11] Patent Number: 5,041,039

[45] Date of Patent: Aug. 20, 1991

[54] STRUCTURE OF AMPHIBIOUS SHOE

[76] Inventor: Jimmy Chang, No. 1, Tzuyu Road Tsun, Tashe, Hsiang, Kaohsing Hsien, Taiwan

[21] Appl. No.: 473,659

[22] Filed: Feb. 1, 1990

[51] Int. Cl.[5] ..... A63B 31/08

[52] U.S. Cl. ..... 441/64; 36/8.1; D21/239

[58] Field of Search ..... 441/55, 75, 61-65; 36/11.5, 113, 8.1; D21/236-239

[56] References Cited

U.S. PATENT DOCUMENTS

| | | | |
|---|---|---|---|
| 1,061,264 | 5/1913 | Bys | 441/64 |
| 2,980,926 | 4/1961 | Wolshin | 441/64 |
| 3,068,499 | 12/1962 | Biskupsky | 441/63 |
| 3,178,738 | 4/1965 | Trell | 441/64 |
| 3,521,312 | 7/1970 | Laniev | 441/64 |
| 3,665,535 | 5/1972 | Picken | 441/64 |
| 3,952,351 | 4/1976 | Gisbert | 441/64 |
| 4,599,071 | 7/1986 | Juanl | 441/64 |
| 4,895,537 | 1/1990 | Ciccotelli | 441/64 |

*Primary Examiner*—Joseph F. Peters, Jr.
*Assistant Examiner*—Clifford T. Bartz
*Attorney, Agent, or Firm*—Fleit, Jacobson, Cohn, Price, Holman & Stern

[57] ABSTRACT

An amphibious shoe, which includes a show body having set therein a fastening plate at its front end for the connection thereto of a diving flipper. The diving flipper includes therein an unitary connecting rubber plate portion having a plurality of through-holes with a plurality of screws screwed upward to fasten in or screwed downward to disconnect from a plurality of internally threaded hollow stubs which extend from the fastening plate of the shoe body, so as to secure the diving flipper to or separate it from the shoe body.

1 Claim, 4 Drawing Sheets

STRUCTURE OF AMPHIBIOUS SHOE

BACKGROUND OF THE INVENTION

The present invention relates to footwear and more particularly to a shoe for wearing on each foot to protect one's foot and to make walking easy as well as swimming and diving.

Regular diving flipper is a large, flat paddlelike rubber device worn on each foot by swimmers or skin divers to increase the force of the kick. However, it is not practical to wear a pair of diving flippers for walking. After getting out of the water, one shall have to take off the flippers from one's feet and wear a pair of regular shoes. It is therefore an object of the present invention to provide an amphibious shoe which is convenient for walking as well as for swimming and diving.

SUMMARY OF THE INVENTION

The present invention relates to an amphibious shoe which includes a releasable diving flipper secured to its front end by screw means. The diving flipper can be conveniently detached from the shoe body when it is used as a footwear to protect the foot for walking. The connection and disconnection of the diving flipper to or from the shoe body is made by means of a plurality of screw means, which are mounted on a connecting rubber plate portion of the diving flipper, to fasten in or disconnect from a plurality of internally threaded hollow stubs, which extend downwardly from a fastening plate received in the bottom sole of the shoe.

BRIEF DESCRIPTION OF THE DRAWINGS

The present invention will be now described by way of example with reference to the annexed drawings, in which.

DETAILED DESCRIPTION OF THE INVENTION

Figure 1:
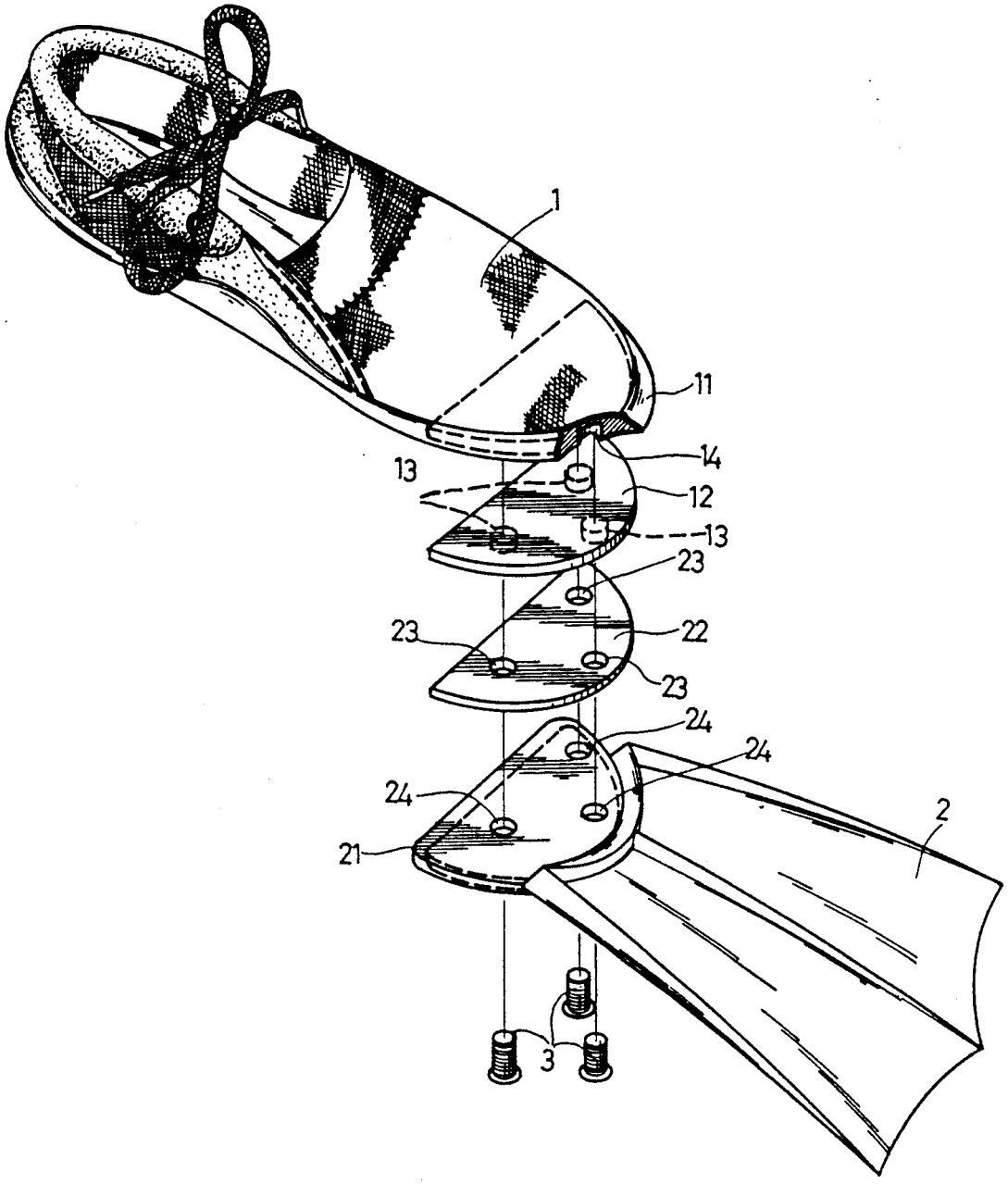
FIG. 1 is a fragmentary perspective view of an amphibious shoe according to the present invention.
Figure 2:
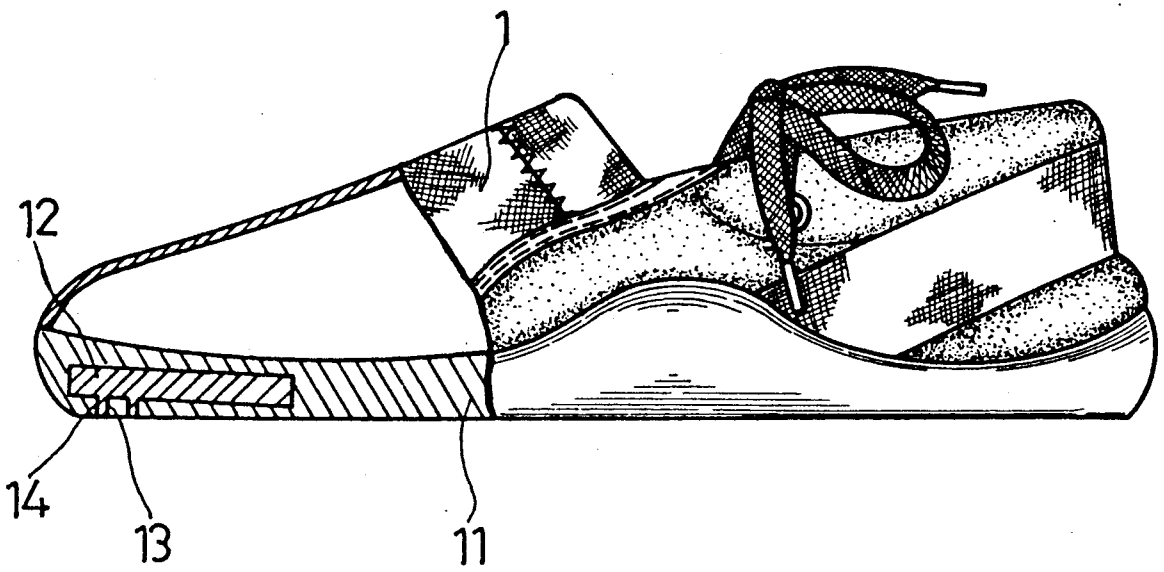
FIG. 2 is a partly sectional view of a shoe according to the present invention.
Figure 3:
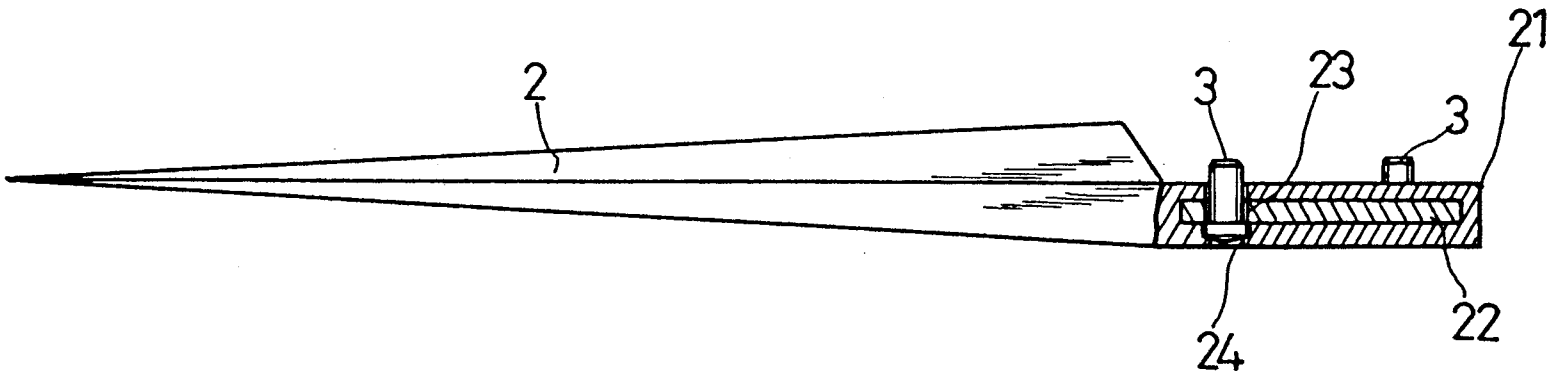
FIG. 3 is a sectional elevation of a diving flipper according to the present invention.

Turning not to the annexed drawings in greater detail and referring first to FIG. 1, therein illustrated is an amphibious shoe in accordance with the present invention which generally comprises a shoe 1 and a diving flipper 2. As illustrated, the shoe 1 comprised a fastening plate 12 fixedly set inside its shoe sole 11 by means of a welding as bonding process and disposed at a front location, which fastening plate 12 comprises a plurality of internally threaded hollow stubs 13 downwardly received each in a hole 14 on the bottom surface of the shoe sole 11 thereof (see FIG. 2). The diving flipper 2 comprises an unitary connecting rubber plate portion 21, which has a plurality of through-holes 24 corresponding to the holes 14 of the shoe 1, and a fastening plate 22, which has a plurality of through-holes 23 corresponding to the through-holes 24 of the connecting rubber plate portion 21 and is fixedly set inside the connecting rubber plate portion 21 through welding process. Postion 21 of the diving flipper 2 are properly designed in such a size suitable for holding a screw 3 each when a screw is inserted therein, permitting such a screw 3 to screw upward and downward (see FIG. 3).

Figure 4:
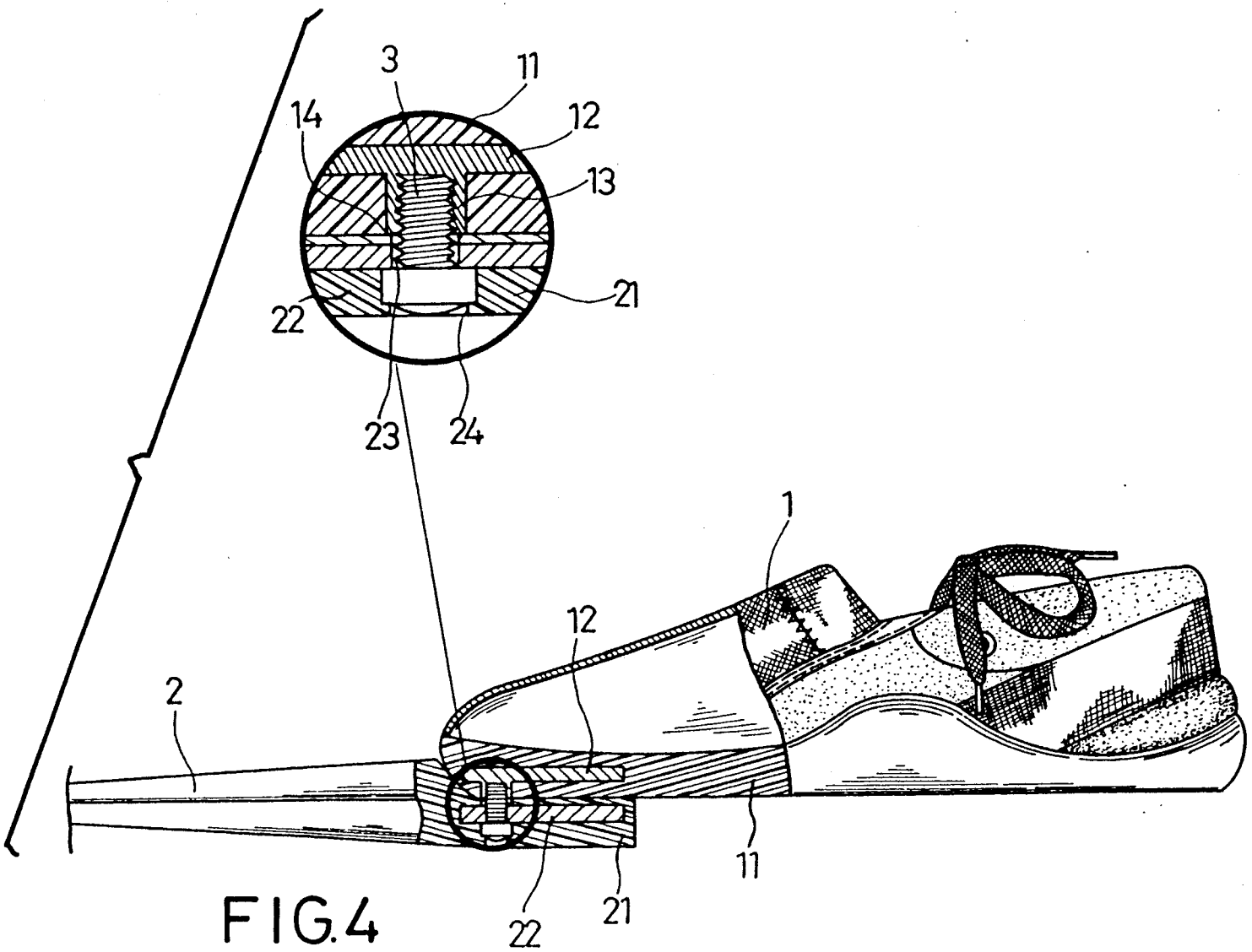
FIG. 4 is a schematic drawing of a partly sectional view, illustrating the incorporation of a diving flipper with a shoe according to the present invention and an enlarged drawing of the incorporating part thereof.

Referring to FIG. 4, when the amphibious shoe of the present invention is to be used for diving or swimming, the diving flipper 2 is attached to the shoe 1 in such a manner that the screws 3 are turned upward to respectively insert in the holes 14 of the shoe sole and screw up with the internally threaded hollow stubs 13 of the fastening plate 12 of the shoe 1 to secure the connection. When being not in use or leaving from the water, the diving flipper 2 can be conveniently detached from the shoe 1 by loosening the screws 3 from the internally threaded hollow stubs 13, and the shoe 1 can be put on one's foot for walking.

I claim:

1. An amphibious shoe, including:

a shoe body comprising an outer sole having set therein a fastening plate at a front location, said fastening plate comprising a plurality of internally threaded hollow stubs downwardly received each in a hole on the bottom surface of said bottom sole; and a diving flipper comprising an unitary connecting rubber plate portion having a plurality of through-holes thereon corresponding to the holes on the bottom sole of said shoe, a fastening plate fixedly set therein, said fastening plate having a plurality of through-holes corresponding to the through-holes of said connecting rubber plate portion, and a plurality of screws retained in the through-holes of said connecting rubber plate portion;

characterized in that said screws can be screwed upward to respectively connect with said internally threaded hollow stubs so as to secure said diving flipper to said shoe body, or unscrewed to respectively disconnect from said internally threaded hollow stubs so as to separate said diving flipper from said shoe body.

* * * * *